US011315449B2

(12) United States Patent
Hao et al.

(10) Patent No.: US 11,315,449 B2
(45) Date of Patent: Apr. 26, 2022

(54) DETECTION CIRCUIT ELECTRICALLY CONNECTED TO TWO SCANNING SIGNAL LINES, TWO DATA SIGNAL LINES AND DIFFERENT COLORED SUB-PIXELS, DISPLAY DEVICE AND DETECTION DRIVING METHOD

(71) Applicant: BOE TECHNOLOGY GROUP CO., LTD., Beijing (CN)

(72) Inventors: Xueguang Hao, Beijing (CN); Yong Qiao, Beijing (CN); Xinyin Wu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 407 days.

(21) Appl. No.: 16/475,373

(22) PCT Filed: Jan. 3, 2019

(86) PCT No.: PCT/CN2019/070209
§ 371 (c)(1),
(2) Date: Jul. 1, 2019

(87) PCT Pub. No.: WO2019/205730
PCT Pub. Date: Oct. 31, 2019

(65) Prior Publication Data

US 2021/0366327 A1 Nov. 25, 2021

(30) Foreign Application Priority Data

Apr. 28, 2018 (CN) ..... 201820625147.3

(51) Int. Cl.
*G09G 3/00* (2006.01)
*G09G 3/20* (2006.01)

(52) U.S. Cl.
CPC ..... *G09G 3/006* (2013.01); *G09G 3/00* (2013.01); *G09G 3/2003* (2013.01)

(58) Field of Classification Search
None
See application file for complete search history.

(56) References Cited

U.S. PATENT DOCUMENTS 6,100,868 A 8/2000 Jeong et al.
2012/0026151 A1* 2/2012 Kim ..... G09G 3/3614 345/212

(Continued)

FOREIGN PATENT DOCUMENTS

CN 104751808 A 7/2015
CN 105632391 A 6/2016

(Continued)

OTHER PUBLICATIONS

International Search Report and English Translation of Box V of the Written Opinion dated Mar. 27, 2019, received for corresponding Chinese PCT Application No. PCT/CN2019/070209, 14 pages.

(Continued)

*Primary Examiner* — Kirk W Hermann
(74) *Attorney, Agent, or Firm* — Kinney & Lange, P.A.

(57) ABSTRACT

A detection circuit includes: a first detection sub-circuit for outputting a first data signal to red sub-pixels under the control of a first scanning signal; a second detection sub-circuit for outputting the first data signal to green sub-pixels under the control of a second scanning signal; a third detection sub-circuit for outputting a second data signal to blue sub-pixels under the control of the second scanning signal; and a fourth detection sub-circuit for outputting the second data signal to preset sub-pixels under the control of (Continued)

the first scanning signal; wherein the preset sub-pixels are any one of red sub-pixels, green sub-pixels and blue sub-pixels.

17 Claims, 3 Drawing Sheets

(56) References Cited

U.S. PATENT DOCUMENTS

| | | | |
|---|---|---|---|
| 2015/0187293 | A1 | 7/2015 | Yoo et al. |
| 2018/0197495 | A1 | 7/2018 | Xu et al. |

FOREIGN PATENT DOCUMENTS

| | | | | |
|---|---|---|---|---|
| CN | 106019743 | A | | 10/2016 |
| CN | 107016954 | A | * | 8/2017 |
| CN | 107016954 | A | | 8/2017 |
| CN | 208027722 | U | | 10/2018 |
| JP | 2015099200 | A | | 5/2015 |

OTHER PUBLICATIONS

Extended European Search Report dated Jan. 4, 2022, received for corresponding European Application No. 19731867.8, p. 12.

* cited by examiner

DETECTION CIRCUIT ELECTRICALLY CONNECTED TO TWO SCANNING SIGNAL LINES, TWO DATA SIGNAL LINES AND DIFFERENT COLORED SUB-PIXELS, DISPLAY DEVICE AND DETECTION DRIVING METHOD

CROSS REFERENCE OF RELATED APPLICATIONS

The present application is the national phase of PCT Application No. PCT/CN2019/070209 filed on Jan. 3, 2019, which in turn claims the benefit of Chinese Patent Application No. 201820625147.3, entitled "Detection Circuit and Display Device," filed on Apr. 28, 2018, which is hereby incorporated herein by reference.

TECHNICAL FIELD

The present disclosure relates to the field of display technology, and in particular to a detection circuit, a display device and a detection driving method.

BACKGROUND

A display panel needs to be electrically tested before the binding of chips and flexible circuits. It is judged whether the display has defects by testing display screens of different colors in order to pick up products with serious display defects timely, for which the following binding of chips and flexible circuits will not be performed.

Therefore, there is a need for a detection circuit capable of testing the display panel.

SUMMARY

According to a first aspect of the present disclosure, a detection circuit is provided which comprises a first detection sub-circuit, a second detection sub-circuit, a third detection sub-circuit and a fourth detection sub-circuit. The first detection sub-circuit is electrically connected to a first scanning signal line, a first data signal line and red sub-pixels, for outputting a signal transmitted on the first data signal line to the red sub-pixels under the control of a signal transmitted on the first scanning signal line. The second detection sub-circuit is electrically connected to a second scanning signal line, the first data signal line and green sub-pixels, for outputting the signal transmitted on the first data signal line to the green sub-pixels under the control of a signal transmitted on the second scanning signal line. The third detection sub-circuit is electrically connected to the second scanning signal line, a second data signal line and blue sub-pixels, for outputting a signal transmitted on the second data signal line to the blue sub-pixels under the control of the signal transmitted on the second scanning signal line. The fourth detection sub-circuit is electrically connected to the first scanning signal line, the second data signal line and preset sub-pixels, for outputting the signal transmitted on the second data signal line to the preset sub-pixels under the control of the signal transmitted on the first scanning signal line. The preset sub-pixels are any one of the red sub-pixels, the green sub-pixels, and the blue sub-pixels.

According to an embodiment of the present disclosure, the first detection sub-circuit comprises a first transistor, wherein a control electrode of the first transistor is electrically connected to the first scanning signal line, a first electrode of the first transistor is electrically connected to the first data signal line, and a second electrode of the first transistor is electrically connected to the red sub-pixels.

According to an embodiment of the present disclosure, the second detection sub-circuit comprises a second transistor, wherein a control electrode of the second transistor is electrically connected to the second scanning signal line, a first electrode of the second transistor is electrically connected to the green sub-pixels, and a second electrode of the second transistor is electrically connected to the first data signal line.

According to an embodiment of the present disclosure, the third detection sub-circuit comprises a third transistor, wherein a control electrode of the third transistor is electrically connected to the second scanning signal line, a first electrode of the third transistor is electrically connected to the blue sub-pixels, and a second electrode of the third transistor is electrically connected to the second data signal line.

According to an embodiment of the present disclosure, the fourth detection sub-circuit comprises a fourth transistor, wherein a control electrode of the fourth transistor is electrically connected to the first scanning signal line, a first electrode of the fourth transistor is electrically connected to the second data signal line, and a second electrode of the fourth transistor is electrically connected to the preset sub-pixels.

According to an embodiment of the present disclosure, the preset sub-pixels are green sub-pixels.

According to an embodiment of the present disclosure, the transistor constituting the first detection sub-circuit and the transistor constituting the third detection sub-circuit are of the same type, and the transistor constituting the second detection sub-circuit and the transistor constituting the fourth detection sub-circuit are of the same type, and the transistor constituting the first detection sub-circuit and the transistor constituting the second detection sub-circuit are of different types.

According to an embodiment of the present disclosure, the transistor constituting the first detection sub-circuit and the transistor constituting the fourth detection sub-circuit are of the same type, and the transistor constituting the second detection sub-circuit and the transistor constituting the third detection sub-circuit are of the same type, and the transistor constituting the first detection sub-circuit and the transistor constituting the second detection sub-circuit are of different types.

According to a second aspect of the present disclosure, a display device comprising any of the detection circuits of the first aspect is provided.

According to a third aspect of the present disclosure, a detection driving method applied in a detection circuit is provided. The detection circuit comprises:

a first detection sub-circuit being electrically connected to a first scanning signal line, a first data signal line and red sub-pixels;

a second detection sub-circuit being electrically connected to a second scanning signal line, the first data signal line and green sub-pixels;

a third detection sub-circuit being electrically connected to the second scanning signal line, a second data signal line and blue sub-pixels; and a fourth detection sub-circuit being electrically connected to the first scanning signal line, the second data signal line and preset sub-pixels, wherein the preset sub-pixels are any one of the red sub-pixels, the green sub-pixels, and the blue sub-pixels.

The detection driving method comprises:

applying a first control signal on the first scan signal line to drive the first detection sub-circuit, and applying a high level signal on the first data signal line, such that the high level signal is output through the first detection sub-circuit to the red sub-pixels; and/or applying a second control signal on the second scan signal line to drive the second detection sub-circuit, and applying a high level signal on the first data signal line, such that the high level signal is output through the second detection sub-circuit to the green sub-pixels; and/or applying a second control signal on the second scan signal line to drive the third detection sub-circuit, and applying a high level signal on the second data signal line, such that the high level signal is output through the third detection sub-circuit to the blue sub-pixels; and/or applying a first control signal on the first scan signal line to drive the fourth detection sub-circuit, and applying a high level signal on the second data signal line, such that the high level signal is output through the fourth detection sub-circuit to the preset sub-pixels.

BRIEF DESCRIPTION OF THE DRAWINGS

In order to more clearly illustrate technical solutions in embodiments of the present disclosure or in the prior art, the drawings to be used in descriptions of the embodiments or the prior art will be briefly described below. It is obvious that the drawings in the following description are only some of the embodiments of the present disclosure. Other drawings may also be obtained by those of ordinary skill in the art according to these drawings without any inventive effort.

DETAILED DESCRIPTION

The technical solutions in the embodiments of the present disclosure will be clearly and completely described in the following with reference to the accompanying drawings in the embodiments of the present disclosure. It is obvious that the described embodiments are only a part but not all of the embodiments of the present disclosure. All other embodiments which may be obtained by those of ordinary skill in the art based on the described embodiments of the invention without any inventive efforts are also within the protection scope of the present invention.

The existing design of the detection circuit has defects in two aspects: in order to realize a test and check of multiple display screens, the designed structure of the existing detection circuit is generally complicated, occupying a large size of frame; while if the detection circuit has a simple structure and does not occupy too much frame area, only test and check of the monochrome screen and the white screen can be performed, and the display defects that can be found under different grayscale or mixed color screens cannot be found in time.

Figure 1:
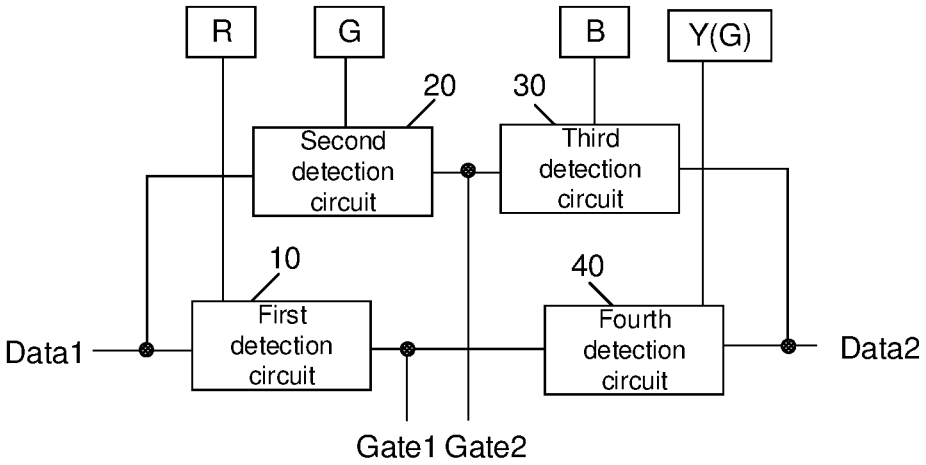
FIG. 1 is a block diagram of a detection circuit according to an embodiment of the present disclosure.

An embodiment of the present disclosure provides a detection circuit of a display panel. As shown in FIG. 1, the detection circuit includes a first detection sub-circuit 10, a second detection sub-circuit 20, a third detection sub-circuit 30, and a fourth detection sub-circuit 40, in which:

The first detection sub-circuit 10 is electrically connected to a first scanning signal line Gate1, a first data signal line Data1 and red sub-pixels R. The first detection sub-circuit 10 outputs a signal transmitted on the first data signal line Data1 to the red sub-pixels R under the control of a signal transmitted on the first scanning signal line Gate1.

The second detection sub-circuit 20 is electrically connected to a second scanning signal line Gate2, the first data signal line Data1 and green sub-pixels G. The second detection sub-circuit 20 outputs the signal transmitted on the first data signal line Data1 to the green sub-pixels G under the control of a signal transmitted on the second scanning signal line Gate2.

The third detection sub-circuit 30 is electrically connected to the second scanning signal line Gate2, a second data signal line Data2 and blue sub-pixels B. The third detection sub-circuit 30 outputs a signal transmitted on the second data signal line Data2 to the blue sub-pixels B under the control of the signal transmitted on the second scanning signal line Gate2.

The fourth detection sub-circuit 40 is electrically connected to the first scanning signal line Gate1, the second data signal line Data2 and preset sub-pixels Y. The third detection sub-circuit 40 outputs the signal transmitted on the second data signal line Data2 to the preset sub-pixels Y under the control of the signal transmitted on the first scanning signal line Gate1, wherein the preset sub-pixels Y are any one of the red sub-pixels R, the green sub-pixels G, and the blue sub-pixels B.

It should be noted that, when each of the detection sub-circuits is electrically connected to respective sub-pixels of the display panel, taking the example that the preset sub-pixels Y are the green sub-pixels G, the second detection sub-circuit 20 is electrically connected to a portion of the green sub-pixels G of the display panel, and the fourth detection sub-circuit 40 is electrically connected to the remaining portion of the green sub-pixels G of the display panel. The detection sub-circuit being electrically connected to the sub-pixels means that the detection sub-circuit is electrically connected to the data line in the sub-pixels. For example, the first detection sub-circuit 10 being electrically connected to the red sub-pixels R means that the first detection sub-circuit 10 is electrically connected to the data line in the red sub-pixels R.

Based on this, an embodiment of the present disclosure provides a detection circuit, wherein the first detection sub-circuit 10 in the detection circuit outputs the signal transmitted on the first data signal line Data1 to the red sub-pixels R under the control of the first scanning signal line Gate1, the second detection sub-circuit 20 outputs the signal transmitted on the first data signal line Data1 to the green sub-pixels R under the control of a signal transmitted on the second scanning signal line Gate2, the third detection sub-circuit 30 outputs the signal transmitted on the second data signal line Data2 to the blue sub-pixels R under the control of a signal transmitted on the second scanning signal line Gate2, and the fourth detection sub-circuit 40 outputs the signal transmitted on the second data signal line Data2 to the preset sub-pixels Y under the control of a signal transmitted on the first scanning signal line Gate1. By controlling the signals transmitted on the first scanning signal line Gate1, the second scanning signal line Gate2, the first data signal line Data1, and the second data signal line Data2, one of the first detection sub-circuit 10, the second detection sub-circuit 20, the third detection sub-circuit 30 and the fourth detection sub-circuit 40 operates to input a signal to sub-pixels of one color to illuminate the sub-pixels of the color, thereby implementing the detection of a monochrome screen; or more than one of the above detection sub-circuits simultaneously operate to input signals to sub-pixels of a plurality of colors to illuminate the sub-pixels of these colors, thereby implementing the detection of a mixed color screen or a white screen. In this way, the defects existing in different screens can be found timely, so as to terminate the display panel manufacturing process in time, avoiding waste of module materials and reducing the manufacturing cost of the display panel.

Figure 2:
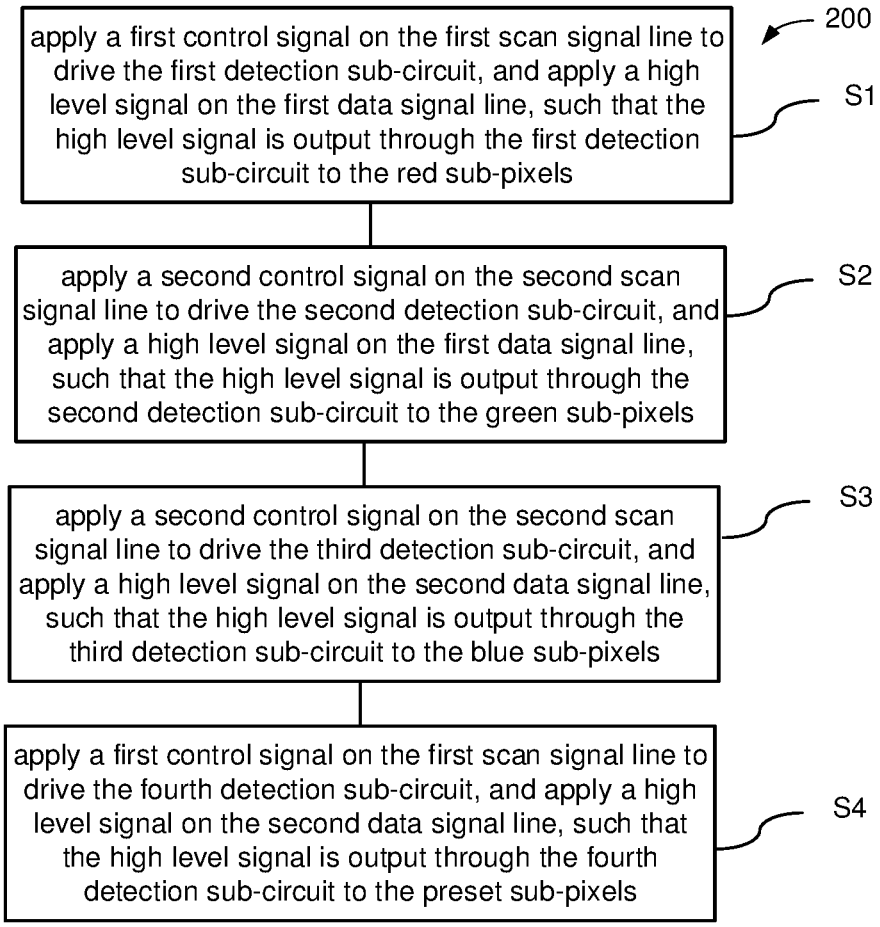
FIG. 2 is a flow chart of a detection driving method according to an embodiment of the present disclosure.

FIG. 2 is a flow chart of a detection driving method according to an embodiment of the present disclosure. As shown in FIG. 2, the detection driving method 200 according to an embodiment of the present disclosure is applied in a detection circuit, the detection circuit comprising: a first detection sub-circuit being electrically connected to a first scanning signal line, a first data signal line and red sub-pixels; a second detection sub-circuit being electrically connected to a second scanning signal line, the first data signal line and green sub-pixels; a third detection sub-circuit being electrically connected to the second scanning signal line, a second data signal line and blue sub-pixels; and a fourth detection sub-circuit being electrically connected to the first scanning signal line, the second data signal line and preset sub-pixels, wherein the preset sub-pixels are any one of the red sub-pixels, the green sub-pixels, and the blue sub-pixels. The detection circuit may be the detection circuit shown in FIG. 1.

As shown in FIG. 2, the detection driving method 200 includes the following steps.

At step S1, a first control signal is applied on the first scan signal line to drive the first detection sub-circuit, and a high level signal is applied on the first data signal line, such that the high level signal is output through the first detection sub-circuit to the red sub-pixels.

At step S2, a second control signal is applied on the second scan signal line to drive the second detection sub-circuit, and a high level signal is applied on the first data signal line, such that the high level signal is output through the second detection sub-circuit to the green sub-pixels.

At step S3, a second control signal is applied on the second scan signal line to drive the third detection sub-circuit, and a high level signal is applied on the second data signal line, such that the high level signal is output through the third detection sub-circuit to the blue sub-pixels.

At step S4, a first control signal is applied on the first scan signal line to drive the fourth detection sub-circuit, and a high level signal is applied on the second data signal line, such that the high level signal is output through the fourth detection sub-circuit to the preset sub-pixels.

Steps S1-S4 in the detection driving method according to an embodiment of the present disclosure may be separately performed to implement the detection of a screen of red, green, blue, or a preset color, respectively. Any two or more of steps S1-S4 in the detection driving method according to an embodiment of the present disclosure may also be combined to achieve the detection of a combined color screen. For example, steps S1 and S2 may be performed simultaneously to achieve the detection of a green+red=yellow screen. As another example, steps S3 and S2 may be performed simultaneously to achieve the detection of a green+blue=cyan screen. As another example, steps S1 and S3 may be performed simultaneously to achieve the detection of a red+blue=purple screen.

The circuit structure of the detection circuit shown in FIG. 1 will be specifically exemplified in the following with reference to specific embodiments.

Figure 3:
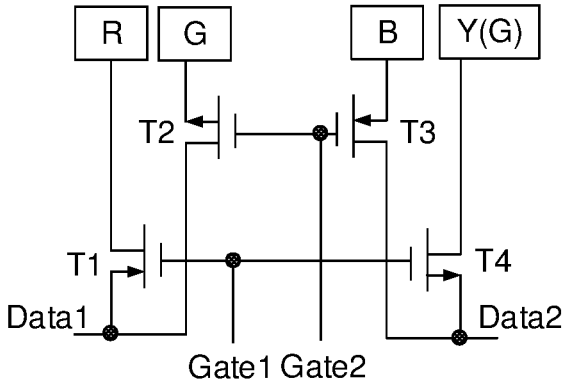
FIG. 3 is a diagram of the circuit structure of the detection circuit shown in FIG. 1.

As shown in FIG. 3, the first detection sub-circuit includes a first transistor T1. The control electrode of the first transistor T1 is electrically connected to the first scanning signal line Gate1, the first electrode of the first transistor T1 is electrically connected to the first data signal line Data1, and the second electrode of the first transistor T1 is electrically connected to the red sub-pixels R.

The second detection sub-circuit 20 includes a second transistor T2. The control electrode of the second transistor T2 is electrically connected to the second scanning signal line Gate2, the first electrode of the second transistor T2 is electrically connected to the green sub-pixels G, and the second electrode of the second transistor T2 is electrically connected to the first data signal line Data1.

The third detection sub-circuit 30 includes a third transistor T3. The control electrode of the third transistor T3 is electrically connected to the second scanning signal line Gate2, the first electrode of the third transistor T3 is electrically connected to the blue sub-pixels B, and the second electrode of the third transistor T3 is electrically connected to the second data signal line Data2.

The fourth detection sub-circuit 40 includes a fourth transistor T4. The control electrode of the fourth transistor T4 is electrically connected to the first scanning signal line Gate1, the first electrode of the fourth transistor T4 is electrically connected to the second data signal line Data2, and the second electrode of the fourth transistor T4 is electrically connected to the preset sub-pixels Y. In the embodiment, the preset sub-pixels Y are exemplified as green sub-pixels G.

Based on this, according to an embodiment of the present disclosure, the transistor constituting the first detection sub-circuit 10 and the transistor constituting the third detection sub-circuit 30 are of the same type, and the transistor constituting the second detection sub-circuit 20 and the transistor constituting the fourth detection sub-circuit 40 are of the same type, and the transistor constituting the first detection sub-circuit 10 and the transistor constituting the second detection sub-circuit 20 are of different types. In this embodiment, the first transistor T1 and the third transistor T3 are transistors of the same type, the second transistor T2 and the fourth transistor T4 are transistors of the same type, and the first transistor T1 and the second transistor T2 are transistors of different types. In FIG. 3, the first transistor T1 and the third transistor T3 are exemplified as P-type transistors, and the second transistor T2 and the fourth transistor T4 are exemplified as N-type transistors. It is known to those skilled in the art that the P-type transistor is turned on at a low level and turned off at a high level; while the N-type transistor is turned on at a high level and turned off at a low level.

On the basis of the above, the detection circuit of the above embodiment has a simple structure, which may reduce the size of the display panel frame, and is beneficial to the development of the narrow frame of the display panel.

The driving method of the detection circuit of the embodiment is described below with reference to FIG. 4, which specifically includes the following.

a first stage P1: the first detection sub-circuit 10 outputs the signal transmitted on the first data signal line Data1 to the red sub-pixels R under the control of the signal transmitted on the first scanning signal line Gate1.

For example, the signals transmitted on the first scan signal line Gate1 and the second scan signal line Gate2 are at a first level, the signal transmitted on the first data signal line Data1 is at a second level, and the signal transmitted on the second data signal line Data2 is at the first level, such that the first detection sub-circuit 10 outputs the signal transmitted on the first data signal line Data1 to the red sub-pixels R under the control of the signal transmitted on the first scanning signal line Gate1.

It should be noted that, in this embodiment, the first transistor T1 and the third transistor T3 are exemplified as P-type transistors, and the second transistor T2 and the fourth transistor T4 are exemplified as N-type transistors. In this case, the first level is a low level and the second level is a high level.

Figure 4:
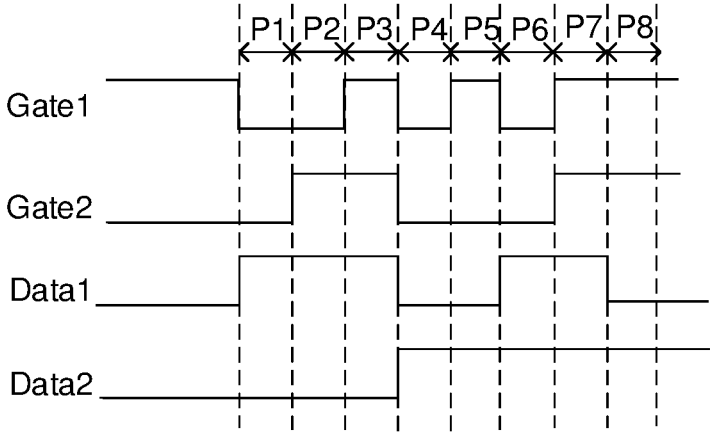
FIG. 4 is a driving timing diagram of the detection circuit shown in FIG. 3 according to an embodiment of the present disclosure.

Specifically, according to FIG. 4, Gate1=0, Gate2=0, Data1=1, Data2=0, in which "1" indicates a high level, "0" indicates a low level. The low level on the gate line indicates a potential with a polarity opposite to the high level, i.e. a negative level, and the low level on the data line is the same as the common level. In this case, the first transistor T1 and the third transistor T3 are turned on, the high level transmitted on the first data signal line Data1 is output to the red sub-pixels R through the first transistor T1 and the red sub-pixels R are illuminated, thereby realizing the detection of a red screen. This stage corresponds to step S1 in FIG. 2.

Or, a second stage P2: the second detection sub-circuit 20 outputs the signal transmitted on the first data signal line Data1 to the green sub-pixels G under the control of the signal transmitted on the second scanning signal line Gate2, and the first detection sub-circuit 10 outputs the signal transmitted on the first data signal line Data1 to the red sub-pixels R under the control of the signal transmitted on the first scanning signal line Gate1.

For example, the signal transmitted on the first scanning signal line Gate1 is at the first level, the signal transmitted on the second scanning signal line Gate2 is at the second level, the signal transmitted on the first data signal line Data1 is at the second level, and the signal transmitted on the second data signal line Data2 is at the first level, such that the second detection sub-circuit 20 outputs the signal transmitted on the first data signal line Data1 to the green sub-pixels G under the control of the signal transmitted on the second scanning signal line Gate2, and that the first detection sub-circuit 10 outputs the signal transmitted on the first data signal line Data1 to the red sub-pixels R under the control of the signal transmitted on the first scanning signal line Gate1.

Specifically, according to FIG. 4, Gate1=0, Gate2=1, Data1=1, and Data2=0. In this case, the first transistor T1 and the second transistor T2 are turned on, and the high level transmitted on the first data signal line Data1 is output to the red sub-pixels R through the first transistor T1 and to the green sub-pixels G through the second transistor T2, whereby the green sub-pixels G and the red sub-pixels R are illuminated, realizing the detection of a yellow screen. This stage corresponds to steps S1+S2 in FIG. 2.

Or, a third stage P3: the second detection sub-circuit 20 outputs the signal transmitted on the first data signal line Data1 to the green sub-pixels G under the control of the signal transmitted on the second scanning signal line Gate2.

For example, the signal transmitted on the first scanning signal line Gate1 is at the second level, the signal transmitted on the second scanning signal line Gate2 is at the second level, the signal transmitted on the first data signal line Data1 is at the second level, and the signal transmitted on the second data signal line Data2 is at the first level, such that the second detection sub-circuit 20 outputs the signal transmitted on the first data signal line Data1 to the green sub-pixels G under the control of the signal transmitted on the second scanning signal line Gate2.

Specifically, according to FIG. 4, Gate1=1, Gate2=1, Data1=1, and Data2=0. In this case, the second transistor T2 and the fourth transistor T4 are turned on, the high level transmitted on the first data signal line Data1 is output to the green sub-pixels G through the second transistor T2 and the green sub-pixels G are illuminated, thereby realizing the detection of a green screen. This stage corresponds to step S2 in FIG. 2.

Or, a fourth stage P4: the third detection sub-circuit 30 outputs the signal transmitted on the second data signal line Data2 to the blue sub-pixels B under the control of the signal transmitted on the second scanning signal line Gate2.

For example, the signals transmitted on the first scan signal line Gate1 and the second scan signal line Gate2 are at the first level, the signal transmitted on the first data signal line Data1 is at the first level, and the signal transmitted on the second data signal line Data2 is at the second level, such that the third detection sub-circuit 30 outputs the signal transmitted on the second data signal line Data2 to the blue sub-pixels B under the control of the signal transmitted on the second scanning signal line Gate2.

Specifically, according to FIG. 4, Gate1=0, Gate2=0, Data1=0, and Data2=1. In this case, the first transistor T1 and the third transistor T3 are turned on, the high level transmitted on the second data signal line Data2 is output to the blue sub-pixels B through the third transistor T3 and the blue sub-pixels B are illuminated, thereby realizing the detection of a blue screen. This stage corresponds to step S3 in FIG. 2.

Or, a fifth stage P5: the third detection sub-circuit 30 outputs the signal transmitted on the second data signal line Data2 to the blue sub-pixels B under the control of the signal transmitted on the second scanning signal line Gate2, and the fourth detection sub-circuit 40 outputs the signal transmitted on the second data signal line Data2 to the preset sub-pixels Y under the control of the signal transmitted on the first scanning signal line Gate1. This embodiment takes outputting the signal transmitted on the second data signal line Data2 to the green sub-pixels G as an example.

For example, the signal transmitted on the first scanning signal line Gate1 is at the second level, the signal transmitted on the second scanning signal line Gate2 is at the first level, the signal transmitted on the first data signal line Data1 is at the first level, and the signal transmitted on the second data signal line Data2 is at the second level, such that the third detection sub-circuit 30 outputs the signal transmitted on the second data signal line Data2 to the blue sub-pixels B under the control of the signal transmitted on the second scanning signal line Gate2, and the fourth detection sub-circuit 40 outputs the signal transmitted on the second data signal line Data2 to the preset sub-pixels Y, i.e. the green sub-pixels G in this embodiment, under the control of the signal transmitted on the first scanning signal line Gate1.

Specifically, according to FIG. 4, Gate1=1, Gate2=0, Data1=0, and Data2=1. In this case, the third transistor T3 and the fourth transistor T4 are turned on, and the high level transmitted on the second data signal line Data2 is output to the blue sub-pixels B through the third transistor T3 and to the green sub-pixels G through the second transistor T2, whereby the green sub-pixels G and the blue sub-pixels B are illuminated, realizing the detection of a cyan screen. This stage corresponds to steps S3+S4 in FIG. 2.

Or, a sixth stage P6: the first detection sub-circuit 10 outputs the signal transmitted on the first data signal line Data1 to the red sub-pixels R under the control of the signal transmitted on the first scanning signal line Gate1, and the third detection sub-circuit 30 outputs the signal transmitted on the second data signal line Data2 to the blue sub-pixels B under the control of the signal transmitted on the second scanning signal line Gate2.

For example, the signals transmitted on the first scan signal line Gate1 and the second scan signal line Gate2 are at the first level, the signals transmitted on the first data signal line Data1 and the second data signal line Data2 are at the second level, such that the first detection sub-circuit 10 outputs the signal transmitted on the first data signal line Data1 to the red sub-pixels R under the control of the signal transmitted on the first scanning signal line Gate1, and the third detection sub-circuit 30 outputs the signal transmitted on the second data signal line Data2 to the blue sub-pixels B under the control of the signal transmitted on the second scanning signal line Gate2.

Specifically, according to FIG. 4, Gate1=0, Gate2=0, Data1=1, and Data2=1. In this case, the first transistor T1 and the third transistor T3 are turned on, and the high level transmitted on the first data signal line Data1 is output to the red sub-pixels R through the first transistor T1, and the high level transmitted on the second data signal line Data2 is output to the blue sub-pixels B through the third transistor T3, whereby the red sub-pixels R and the blue sub-pixels B are illuminated, realizing the detection of a purple screen. This stage corresponds to steps S1+S3 in FIG. 2.

Or, a seventh stage P7: the second detection sub-circuit 20 outputs the signal transmitted on the first data signal line Data1 to the green sub-pixels G under the control of the signal transmitted on the second scanning signal line Gate2, and the fourth detection sub-circuit 40 outputs the signal transmitted on the second data signal line Data2 to the preset sub-pixels Y, i.e. the green sub-pixels G, under the control of the signal transmitted on the first scanning signal line Gate1.

For example, the signals transmitted on the first scan signal line Gate1 and the second scan signal line Gate2 are at the second level, the signal transmitted on the first data signal line Data1 is at the second level, and the signal transmitted on the second data signal line Data2 is at the second level, such that the second detection sub-circuit 20 outputs the signal transmitted on the first data signal line Data1 to the green sub-pixels G under the control of the signal transmitted on the first scanning signal line Gate1, and that the fourth detection sub-circuit 40 outputs the signal transmitted on the second data signal line Data2 to the preset sub-pixels Y, i.e. the green sub-pixels G, under the control of the signal transmitted on the second scanning signal line Gate2.

Specifically, according to FIG. 4, Gate1=1, Gate2=1, Data1=1, and Data2=1. In this case, the second transistor T2 and the fourth transistor T4 are turned on, the high level transmitted on the first data signal line Data1 is output to the green sub-pixels G through the second transistor T2 and the green sub-pixels G are illuminates, and the high level transmitted on the second data signal line Data2 is output to the preset sub-pixels Y, i.e. the green sub-pixels G, through the fourth transistor T4 and the green sub-pixels G are illuminated. This stage corresponds to steps S2+S4 in FIG. 2.

Or, an eighth stage P8: the fourth detection sub-circuit 40 outputs the signal transmitted on the second data signal line Data2 to the preset sub-pixels Y, i.e. the green sub-pixels G, under the control of the signal transmitted on the first scanning signal line Gate1.

For example, the signals transmitted on the first scan signal line Gate1 and the second scan signal line Gate2 are at the second level, the signal transmitted on the first data signal line Data1 is at the first level, and the signal transmitted on the second data signal line Data2 is at the second level, such that the fourth detection sub-circuit 40 outputs the signal transmitted on the second data signal line Data2 to the preset sub-pixels Y, i.e. the green sub-pixels G, under the control of the signal transmitted on the second scanning signal line Gate2.

Specifically, according to FIG. 4, Gate1=1, Gate2=1, Data1=0, and Data2=1. In this case, the fourth transistor T4 is turned on, the high level transmitted on the second data signal line Data2 is output to the preset sub-pixels Y, i.e. the green sub-pixels G, through the fourth transistor T4 and the green sub-pixels G are illuminated. This stage corresponds to step S4 in FIG. 2.

Note, it can be understood by those skilled in the art that, when the first transistor T1 and the third transistor T3 are N-type transistors and the second transistor T2 and the fourth transistor T4 are P-type transistors, the first level is a high level and the second level is a low level. In this case, the on/off conditions of the transistors and the principle for illuminating the pixels of different colors are the same as described above, and details thereof are not described herein again.

Based on this, the detection circuit provided by the embodiments of the present disclosure can implement detections of a monochrome screen and a mixed color screen.

Figure 5:
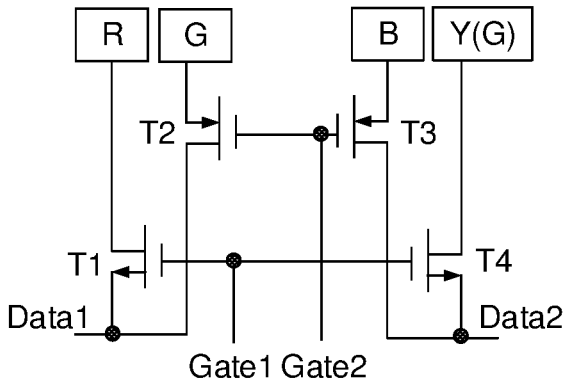
FIG. 5 is another diagram of the circuit structure of the detection circuit shown in FIG. 1.

FIG. 5 illustrates another embodiment different from the above embodiment, where the transistor constituting the first detection sub-circuit 10 and the transistor constituting the fourth detection sub-circuit 40 are of the same type, the transistor constituting the second detection sub-circuit 20 and the transistor constituting the third detection sub-circuit 30 are of the same type, and the transistor constituting the first detection sub-circuit 10 and the transistor constituting the second detection sub-circuit 20 are of different types. In this embodiment, the first transistor T1 and the fourth transistor T4 are transistors of the same type, the second transistor T2 and the third transistor T3 are transistors of the same type, and the first transistor T1 and the second transistor T2 are transistors of different types. In FIG. 5, the second transistor T2 and the third transistor T3 are exemplified as P-type transistors, and the first transistor T1 and the fourth transistor T4 are exemplified as N-type transistors.

The driving method of the detection circuit of the other embodiment is described below with reference to FIG. 6, which specifically includes:

a first stage P1: the first detection sub-circuit 10 outputs the signal transmitted on the first data signal line Data1 to the red sub-pixels R under the control of the signal transmitted on the first scanning signal line Gate1.

For example, the signals transmitted on the first scan signal line Gate1 and the second scan signal line Gate2 are at a second level, the signal transmitted on the first data signal line Data1 is at the second level, and the signal transmitted on the second data signal line Data2 is at a first level, such that the first detection sub-circuit 10 outputs the signal transmitted on the first data signal line Data1 to the red sub-pixels R under the control of the signal transmitted on the first scanning signal line Gate1.

It should be noted that, in this embodiment, the first transistor T1 and the fourth transistor T4 are exemplified as N-type transistors, and the second transistor T2 and the third transistor T3 are exemplified as P-type transistors. In this case, the first level is a low level and the second level is a high level.

Figure 6:
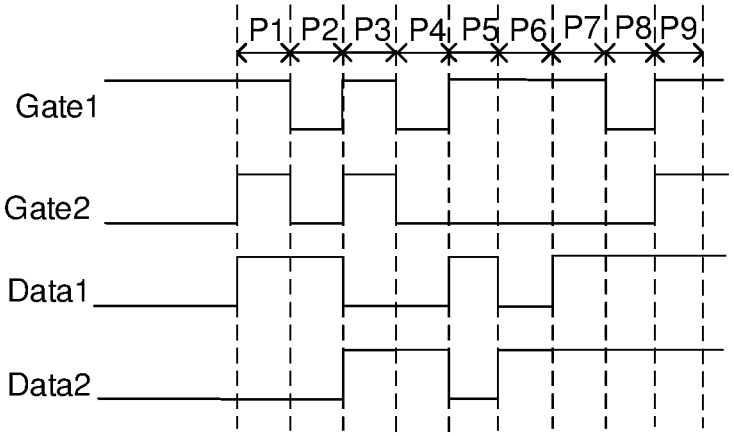
FIG. 6 is a driving timing diagram of the detection circuit shown in FIG. 5 according to an embodiment of the present disclosure.

Specifically, according to FIG. 6, Gate1=1, Gate2=1, Data1=1, Data2=0, in which "1" indicates a high level, "0" indicates a low level. The low level on the gate line indicates a potential with a polarity opposite to the high level, i.e. a negative level, and the low level on the data line is the same as the common level. In this case, the first transistor T1 and the fourth transistor T4 are turned on, the high level transmitted on the first data signal line Data1 is output to the red sub-pixels R through the first transistor T1 and the red sub-pixels R are illuminated, thereby realizing the detection of a red screen. This stage corresponds to step S1 in FIG. 2.

Or, a second stage P2: the second detection sub-circuit 20 outputs the signal transmitted on the first data signal line Data1 to the green sub-pixels G under the control of the signal transmitted on the second scanning signal line Gate2.

For example, the signals transmitted on the first scanning signal line Gate1 and the second scanning signal line Gate2 are at the first level, the signal transmitted on the first data signal line Data1 is at the second level, and the signal transmitted on the second data signal line Data2 is at the first level, such that the second detection sub-circuit 20 outputs the signal transmitted on the first data signal line Data1 to the green sub-pixels G under the control of the signal transmitted on the second scanning signal line Gate2.

Specifically, according to FIG. 6, Gate1=0, Gate2=0, Data1=1, and Data2=0. In this case, the second transistor T2 and the third transistor T3 are turned on, the high level transmitted on the first data signal line Data1 is output to the green sub-pixels G through the second transistor T2 and the green sub-pixels G are illuminated, thereby realizing the detection of a green screen. This stage corresponds to step S2 in FIG. 2.

Or, a third stage P3: the fourth detection sub-circuit 40 outputs the signal transmitted on the second data signal line Data2 to the preset sub-pixels Y under the control of the signal transmitted on the first scanning signal line Gate1, where the preset sub-pixels Y are any one of the red sub-pixels R, the green sub-pixels G, and the blue sub-pixels B. According to an embodiment of the present disclosure, the preset sub-pixels Y are green sub-pixels.

For example, the signals transmitted on the first scan signal line Gate1 and the second scan signal line Gate2 are at the second level, the signal transmitted on the first data signal line Data1 is at the first level, and the signal transmitted on the second data signal line Data2 is at the second level, such that the fourth detection sub-circuit 40 outputs the signal transmitted on the second data signal line Data2 to the preset sub-pixels Y under the control of the signal transmitted on the first scanning signal line Gate1, where the preset sub-pixels Y are any one of the red sub-pixels R, the green sub-pixels G, and the blue sub-pixels B.

Specifically, according to FIG. 6, Gate1=1, Gate2=1, Data1=0, and Data2=1. In this case, the first transistor T1 and the fourth transistor T4 are turned on, the high level transmitted on the second data signal line Data2 is output to the green sub-pixels G through the fourth transistor T4 and a half of the green sub-pixels G are illuminated, thereby realizing the detection of a green screen. This stage corresponds to step S4 in FIG. 2.

Or, a fourth stage P4: the third detection sub-circuit 30 outputs the signal transmitted on the second data signal line Data2 to the blue sub-pixels B under the control of the signal transmitted on the second scanning signal line Gate2.

For example, the signals transmitted on the first scanning signal line Gate1 and the second scanning signal line Gate2 are at the first level, the signal transmitted on the first data signal line Data1 is at the first level, and the signal transmitted on the second data signal line Data2 is at the second level, such that the third detection sub-circuit 30 outputs the signal transmitted on the second data signal line Data2 to the blue sub-pixels B under the control of the signal transmitted on the second scanning signal line Gate2.

Specifically, according to FIG. 6, Gate1=0, Gate2=0, Data1=0, and Data2=1. In this case, the second transistor T2 and the third transistor T3 are turned on, the high level transmitted on the second data signal line Data2 is output to the blue sub-pixels B through the third transistor T3 and the blue sub-pixels B are illuminated, thereby realizing the detection of a blue screen. This stage corresponds to step S3 in FIG. 2.

Or, a fifth stage P5: the first detection sub-circuit 10 outputs the signal transmitted on the first data signal line Data1 to the red sub-pixels R under the control of the signal transmitted on the first scanning signal line Gate1, and the second detection sub-circuit 20 outputs the signal transmitted on the first data signal line Data1 to the green sub-pixels G under the control of the signal transmitted on the second scanning signal line Gate2.

For example, the signal transmitted on the first scan signal line Gate1 is at the second level, the signal transmitted on the second scan signal line Gate2 is at the first level, the signal transmitted on the first data signal line Data1 is at the second level, and the signal transmitted on the second data signal line Data2 is at the first level, such that the first detection sub-circuit 10 outputs the signal transmitted on the first data signal line Data1 to the red sub-pixels R under the control of the signal transmitted on the first scanning signal line Gate1, and that the second detection sub-circuit 20 outputs the signal transmitted on the first data signal line Data1 to the green sub-pixels G under the control of the signal transmitted on the second scanning signal line Gate2.

Specifically, according to FIG. 6, Gate1=1, Gate2=0, Data1=1, and Data2=0. In this case, the first transistor T1, the second transistor T2, the third transistor T3 and the fourth transistor T4 are turned on, and the high level transmitted on the first data signal line Data1 is output to the red sub-pixels R through the first transistor T1 and to the green sub-pixels G through the second transistor T2, whereby the red sub-pixels R and a portion of the green sub-pixels G are illuminated, realizing the detection of a yellow screen. This stage corresponds to steps S1+Ω in FIG. 2.

Or, a sixth stage P6: the third detection sub-circuit 30 outputs the signal transmitted on the second data signal line Data2 to the blue sub-pixels B under the control of the signal transmitted on the second scanning signal line Gate2, and the fourth detection sub-circuit 40 outputs the signal transmitted on the second data signal line Data2 to the preset sub-pixels Y, i.e. the green sub-pixels G, under the control of the signal transmitted on the first scanning signal line Gate1.

For example, the signal transmitted on the first scanning signal line Gate1 is at the second level, the signal transmitted on the second scanning signal line Gate2 is at the first level, the signal transmitted on the first data signal line Data1 is at the first level, and the signal transmitted on the second data signal line Data2 is at the second level, such that the third detection sub-circuit 30 outputs the signal transmitted on the second data signal line Data2 to the blue sub-pixels B under the control of the signal transmitted on the second scanning signal line Gate2, and the fourth detection sub-circuit 40 outputs the signal transmitted on the second data signal line Data2 to the preset sub-pixels Y, i.e. the green sub-pixels G, under the control of the signal transmitted on the first scanning signal line Gate1.

Specifically, according to FIG. 6, Gate1=1, Gate2=0, Data1=0, and Data2=1. In this case, the first transistor T1, the second transistor T2, the third transistor T3 and the fourth transistor T4 are turned on, and the high level transmitted on the second data signal line Data2 is output to the blue sub-pixels B through the third transistor T3 and to a portion of the green sub-pixels G through the fourth transistor T4, whereby the blue sub-pixels B and the portion of the green sub-pixels G are illuminated, realizing the detection of a cyan screen. This stage corresponds to steps S3+S4 in FIG. 2.

Or, a seventh stage P7: under the control of the signal transmitted on the first scanning signal line Gate1, the first detection sub-circuit 10 outputs the signal transmitted on the first data signal line Data1 to the red sub-pixels R, and the fourth detection sub-circuit 40 outputs the signal transmitted on the second data signal line Data2 to the preset sub-pixels Y, i.e. a half of the green sub-pixels G; and under the control of the signal transmitted on the second scanning signal line Gate2, the second detection sub-circuit 20 outputs the signal transmitted on the first data signal line Data1 to another half of the green sub-pixels G, and the third detection sub-circuit 30 outputs the signal transmitted on the second data signal line Data2 to the blue sub-pixels B.

For example, the signal transmitted on the first scan signal line Gate1 is at the second level, the signal transmitted on the second scan signal line Gate2 is at the first level, the signals transmitted on the first data signal line Data1 and the second data signal line Data2 are at the second level, such that under the control of the signal transmitted on the first scanning signal line Gate1, the first detection sub-circuit 10 outputs the signal transmitted on the first data signal line Data1 to the red sub-pixels R, and the fourth detection sub-circuit 40 outputs the signal transmitted on the second data signal line Data2 to the preset sub-pixels Y, i.e. a half of the green sub-pixels G; and under the control of the signal transmitted on the second scanning signal line Gate2, the second detection sub-circuit 20 outputs the signal transmitted on the first data signal line Data1 to another half of the green sub-pixels G, and the third detection sub-circuit 30 outputs the signal transmitted on the second data signal line Data2 to the blue sub-pixels B.

Specifically, according to FIG. 6, Gate1=1, Gate2=0, Data1=1, and Data2=1. In this case, the first transistor T1, the second transistor T2, the third transistor T3 and the fourth transistor T4 are turned on, and the high level transmitted on the first data signal line Data1 is output to the red sub-pixels R through the first transistor T1 and to a half of the green sub-pixels G through the second transistor T2, the high level transmitted on the second data signal line Data2 is output to the blue sub-pixels B through the third transistor T3 and to another half of the green sub-pixels G through the fourth transistor T4, whereby the red sub-pixels R, the green sub-pixels G and the blue sub-pixels B are illuminated, realizing the detection of a white screen. This stage corresponds to steps S1+S2+S3+S4 in FIG. 2.

Or, an eighth stage P8: the second detection sub-circuit 20 outputs the signal transmitted on the first data signal line Data1 to the green sub-pixels G under the control of the signal transmitted on second scanning signal line Gate2, and the third detection sub-circuit 30 outputs the signal transmitted on the second data signal line Data2 to the blue sub-pixels B under the control of the signal transmitted on the second scanning signal line Gate2.

For example, the signals transmitted on the first scanning signal line Gate1 and the second scanning signal line Gate2 are at the first level, the signals transmitted on the first data signal line Data1 and the second data signal line Data2 are at the second level, such that the second detection sub-circuit 20 outputs the signal transmitted on the first data signal line Data1 to the green sub-pixels G under the control of the signal transmitted on the second scanning signal line Gate2, and that the third detection sub-circuit 30 outputs the signal transmitted on the second data signal line Data2 to the blue sub-pixels B under the control of the signal transmitted on the second scanning signal line Gate2.

Specifically, according to FIG. 6, Gate1=0, Gate2=0, Data1=1, and Data2=1. In this case, the second transistor T2 and the third transistor T3 are turned on, and the high level transmitted on the first data signal line Data1 is output to the green sub-pixels G through the second transistor T2, the high level transmitted on the second data signal line Data2 is output to the blue sub-pixels B through the third transistor T3, whereby the green sub-pixels G and the blue sub-pixels B are illuminated, realizing the detection of a cyan screen. This stage corresponds to steps S2+S3 in FIG. 2.

Or, a ninth stage P9: the first detection sub-circuit 10 outputs the signal transmitted on the first data signal line Data1 to the red sub-pixels R under the control of the signal transmitted on the first scanning signal line Gate1, and the fourth detection sub-circuit 40 outputs the signal transmitted on the second data signal line Data2 to the preset sub-pixels, i.e. the green sub-pixels G, under the control of the signal transmitted on the second scanning signal line Gate2.

For example, the signals transmitted on the first scan signal line Gate1, the second scan signal line Gate2, the first data signal line Data1 and the second data signal line Data2 are all at the second level, such that the first detection sub-circuit 10 outputs the signal transmitted on the first data signal line Data1 to the red sub-pixels R under the control of the signal transmitted on the first scanning signal line Gate1, and that the fourth detection sub-circuit 40 outputs the signal transmitted on the second data signal line Data2 to the preset sub-pixels Y, i.e. the green sub-pixels G, under the control of the signal transmitted on the first scanning signal line Gate1.

Specifically, according to FIG. 6, Gate1=1, Gate2=1, Data1=1, and Data2=1. In this case, the first transistor T1 and the fourth transistor T4 are turned on, and the high level transmitted on the first data signal line Data1 is output to the red sub-pixels R through the first transistor T1, and the high level transmitted on the second data signal line Data2 is output to the green sub-pixels B through the fourth transistor T4, whereby the red sub-pixels R and the green sub-pixels G are illuminated, realizing the detection of a yellow screen. This stage corresponds to steps S1+S4 in FIG. 2.

Note, it can be understood by those skilled in the art that, when the first transistor T1 and the fourth transistor T4 are N-type transistors and the second transistor T2 and the third transistor T3 are P-type transistors, the first level is a high level and the second level is a low level. In this case, the on/off conditions of the transistors and the principle for illuminating the pixels of different colors are the same as described above, and details thereof are not described herein again.

Based on this, the detection circuit provided by the embodiments of the present disclosure can implement detections of a monochrome screen, a mixed color screen and a white screen.

It should be noted that, when the detection circuit provided by the embodiments of the present disclosure is driven by using the driving timings shown in FIG. 4 and FIG. 6, the driving order is not limited to the order of stages shown in the figures. Specifically, it is possible to select the driving timing of a stage in the figures for the detection circuit according to an actual detected screen.

Embodiments of the present disclosure further provide a display device including any of the detection circuits as provided in the foregoing embodiments. The display device has the same structure and advantageous effects as the foregoing detection circuits, which will not be described again here since detailed description thereof has been provided by the foregoing embodiments.

According to the detection circuit, the display device, and the detection driving method provided by the embodiments of the present disclosure, the monochrome screen, the white screen, and the mixed color screen are tested by using a detection circuit with a simple structure, so that defects in different screens can be found timely.

It should be understood by those skilled in the art that all or part of the steps for implementing the above method embodiments may be implemented by using hardware related to program, and the program may be stored in a computer readable storage medium, which, when executed, may perform the steps of the foregoing method embodiments. The storage medium mentioned above includes: a medium that can store program codes, such as a ROM, a RAM, a magnetic disk, or an optical disk.

The above description is only a specific embodiment of the present disclosure, but the scope of the present disclosure is not limited thereto, and those skilled in the art can easily anticipate changes or alternatives within the technical scope disclosed by the present disclosure, which should be covered within the protection scope of the present disclosure. Therefore, the protection scope of the present disclosure should follow the protection scope of the claims.

We claim:

1. A detection circuit, comprising:

a first detection sub-circuit being electrically connected to a first scanning signal line, a first data signal line and red sub-pixels, for outputting a signal transmitted on the first data signal line to the red sub-pixels under the control of a signal transmitted on the first scanning signal line;

a second detection sub-circuit being electrically connected to a second scanning signal line, the first data signal line and green sub-pixels, for outputting the signal transmitted on the first data signal line to the green sub-pixels under the control of a signal transmitted on the second scanning signal line;

a third detection sub-circuit being electrically connected to the second scanning signal line, a second data signal line and blue sub-pixels, for outputting a signal transmitted on the second data signal line to the blue sub-pixels under the control of the signal transmitted on the second scanning signal line; and a fourth detection sub-circuit being electrically connected to the first scanning signal line, the second data signal line and preset sub-pixels, for outputting the signal transmitted on the second data signal line to the preset sub-pixels under the control of the signal transmitted on the first scanning signal line, wherein the preset sub-pixels are any one of the red sub-pixels, the green sub-pixels, and the blue sub-pixels.

2. The detection circuit according to claim 1, wherein the first detection sub-circuit comprises a first transistor, and wherein a control electrode of the first transistor is electrically connected to the first scanning signal line, a first electrode of the first transistor is electrically connected to the first data signal line, and a second electrode of the first transistor is electrically connected to the red sub-pixels.

3. The detection circuit according to claim 2, wherein the second detection sub-circuit comprises a second transistor, and wherein a control electrode of the second transistor is electrically connected to the second scanning signal line, a first electrode of the second transistor is electrically connected to the green sub-pixels, and a second electrode of the second transistor is electrically connected to the first data signal line.

4. The detection circuit according to claim 3, wherein the third detection sub-circuit comprises a third transistor, and wherein a control electrode of the third transistor is electrically connected to the second scanning signal line, a first electrode of the third transistor is electrically connected to the blue sub-pixels, and a second electrode of the third transistor is electrically connected to the second data signal line.

5. The detection circuit according to claim 4, wherein the fourth detection sub-circuit comprises a fourth transistor, and wherein a control electrode of the fourth transistor is electrically connected to the first scanning signal line, a first electrode of the fourth transistor is electrically connected to the second data signal line, and a second electrode of the fourth transistor is electrically connected to the preset sub-pixels.

6. The detection circuit according to claim 1, wherein the second detection sub-circuit comprises a second transistor, and wherein a control electrode of the second transistor is electrically connected to the second scanning signal line, a first electrode of the second transistor is electrically connected to the green sub-pixels, and a second electrode of the second transistor is electrically connected to the first data signal line.

7. The detection circuit according to claim 1, wherein the third detection sub-circuit comprises a third transistor, and wherein a control electrode of the third transistor is electrically connected to the second scanning signal line, a first electrode of the third transistor is electrically connected to the blue sub-pixels, and a second electrode of the third transistor is electrically connected to the second data signal line.

8. The detection circuit according to claim 1, wherein the fourth detection sub-circuit comprises a fourth transistor, and wherein a control electrode of the fourth transistor is electrically connected to the first scanning signal line, a first electrode of the fourth transistor is electrically connected to the second data signal line, and a second electrode of the fourth transistor is electrically connected to the preset sub-pixels.

9. The detection circuit according to claim 1, wherein the preset sub-pixels are green sub-pixels.

10. The detection circuit according to claim 1, wherein a transistor constituting the first detection sub-circuit and a transistor constituting the third detection sub-circuit are of a same type, and a transistor constituting the second detection sub-circuit and a transistor constituting the fourth detection sub-circuit are of a same type, and the transistor constituting the first detection sub-circuit and the transistor constituting the second detection sub-circuit are of different types.

11. The detection circuit according to claim 1, wherein a transistor constituting the first detection sub-circuit and a transistor constituting the fourth detection sub-circuit are of a same type, and a transistor constituting the second detection sub-circuit and a transistor constituting the third detection sub-circuit are of a same type, and the transistor constituting the first detection sub-circuit and the transistor constituting the second detection sub-circuit are of different types.

12. A display device comprising the detection circuit of claim 1.

13. A detection driving method applied in a detection circuit, the detection circuit comprising:

a first detection sub-circuit being electrically connected to a first scanning signal line, a first data signal line and red sub-pixels;

a second detection sub-circuit being electrically connected to a second scanning signal line, the first data signal line and green sub-pixels;

a third detection sub-circuit being electrically connected to the second scanning signal line, a second data signal line and blue sub-pixels; and a fourth detection sub-circuit being electrically connected to the first scanning signal line, the second data signal line and preset sub-pixels, wherein the preset sub-pixels are any one of the red sub-pixels, the green sub-pixels, and the blue sub-pixels;

wherein the detection driving method comprises one or more of the following:

applying a first control signal on the first scanning signal line to drive the first detection sub-circuit, and applying a high level signal on the first data signal line, such that the high level signal is output through the first detection sub-circuit to the red sub-pixels;

applying a second control signal on the second scanning signal line to drive the second detection sub-circuit, and applying a high level signal on the first data signal line, such that the high level signal is output through the second detection sub-circuit to the green sub-pixels;

applying a second control signal on the second scanning signal line to drive the third detection sub-circuit, and applying a high level signal on the second data signal line, such that the high level signal is output through the third detection sub-circuit to the blue sub-pixels; or applying a first control signal on the first scanning signal line to drive the fourth detection sub-circuit, and applying a high level signal on the second data signal line, such that the high level signal is output through the fourth detection sub-circuit to the preset sub-pixels.

14. The detection driving method according to claim 13, wherein the first detection sub-circuit comprises a first transistor, and wherein a control electrode of the first transistor is electrically connected to the first scanning signal line, a first electrode of the first transistor is electrically connected to the first data signal line, and a second electrode of the first transistor is electrically connected to the red sub-pixels.

15. The detection driving method according to claim 14, wherein the second detection sub-circuit comprises a second transistor, and wherein a control electrode of the second transistor is electrically connected to the second scanning signal line, a first electrode of the second transistor is electrically connected to the green sub-pixels, and a second electrode of the second transistor is electrically connected to the first data signal line.

16. The detection driving method according to claim 15, wherein the third detection sub-circuit comprises a third transistor, and wherein a control electrode of the third transistor is electrically connected to the second scanning signal line, a first electrode of the third transistor is electrically connected to the blue sub-pixels, and a second electrode of the third transistor is electrically connected to the second data signal line.

17. The detection driving method according to claim 16, wherein the fourth detection sub-circuit comprises a fourth transistor, and wherein a control electrode of the fourth transistor is electrically connected to the first scanning signal line, a first electrode of the fourth transistor is electrically connected to the second data signal line, and a second electrode of the fourth transistor is electrically connected to the preset sub-pixels.

* * * * *